United States Patent [19]

D'Ambrosio

[11] 4,274,659

[45] Jun. 23, 1981

[54] ADJUSTABLE BOOK COVER

[76] Inventor: Joseph J. D'Ambrosio, 13970 Peach Grove St., Sherman Oaks, Calif. 91423

[21] Appl. No.: 55,687

[22] Filed: Jul. 6, 1979

[51] Int. Cl.[3] ..... B42D 3/00

[52] U.S. Cl. ..... 281/34; 281/31

[58] Field of Search ..... 281/29, 31, 34

[56] References Cited

U.S. PATENT DOCUMENTS

| | | | |
|---|---|---|---|
| 307,004 | 10/1884 | Birchard et al. | 281/34 |
| 540,469 | 6/1895 | Tilley | 281/34 |
| 2,190,055 | 2/1940 | Davidson | 281/34 |

FOREIGN PATENT DOCUMENTS

| | | | |
|---|---|---|---|
| 231957 | 2/1964 | Austria | 281/34 |
| 1522383 | 4/1968 | France | 281/34 |
| 683585 | 12/1952 | United Kingdom | 281/34 |

*Primary Examiner*—Paul A. Bell

*Attorney, Agent, or Firm*—Vogel, Dithmar, Stotland, Stratman & Levy

[57] ABSTRACT

There is provided a protective and adjustable book cover for paperback books and magazines and the like, which has two complimentary sized cover sections having opposed and spaced apart plies connected along three edges thereof forming a pocket with the remaining edges open. The plies are spaced apart a distance sufficient to receive therebetween the cover of an associated book or magazine and are connected by a spine between the complimentary pocket shaped cover sections. The spine has a transverse dimension substantially coextensive with the open edges of the cover sections, and finally means resiliently connect the spine to at least one of the cover sections to provide an adjustable book cover for paperback books or magazines of various thicknesses and size.

9 Claims, 8 Drawing Figures

ADJUSTABLE BOOK COVER

BACKGROUND OF THE INVENTION

For many years, various types of protective covers formed from paper have been available for covering books and especially books having stiff covers. However, paperback books have increasingly come into use because of their lower cost as compared to hard cover books. One problem with paperback books is that the covers thereof are easily bent, frayed or otherwise mutilated, rendering the book unsightly. While it is desirable to have protective covers for paperback books, magazines, technical journals and the like which prevent the covers thereof from becoming worn, bent, frayed or otherwise mutilated, no cover has been made available which is adjustable to accommodate books of varying thicknesses which is easy to manipulate and is not unsightly or ungainly to use.

To apply a certain specific size protective book cover respectfully to a relatively thin book and also to a relatively thick book of the same size usually results in the protective cover being much too large for the thin book so that a very loose fitting results and the desired support and protection is not realized, while if the same cover is applied to a relatively thick book and particularly one which is too thick to actually be accommodated by such protective cover, damage will be sustained by the book after a relatively short period of time with the spine of the book covers becoming broken as well as other forms of disfigurement.

Various attempts have been made to provide adjustable book covers, but none has resulted in a completely satisfactory book cover, particularly for use with the so called paperback books. Representative efforts in this field are the disclosures of the Birchard et al. U.S. Pat. No. 307,004; the Tilley U.S. Pat. No. 540,469; the Nourse U.S. Pat. No. 770,692; the Bull U.S. Pat. No. 1,472,789; the Ayers et al. U.S. Pat. No. 3,002,768; and the Learned et al. U.S. Pat. No. 3,572,767. While all of these patents to some degree or another show a protective cover for a book, magazine or pamphlet, and in some cases the covers are adjustable, none of the patents provide an automatically ajdustable protective cover of the type hereinafter set forth.

SUMMARY OF THE INVENTION

This invention relates to a protective book cover which is automatically adjustable to accommodate books of varying thicknesses.

The principal object of the present invention is to provide a protective and adjustable book cover for paperback books and magazines and the like, the cover comprising two complimentary sized cover sections having opposed and spaced apart plies connected along three edges thereof forming a pocket with the remaining edges open, the plies being spaced apart at a distance sufficient to receive therebetween the cover of an associated book or magazine, a spine connecting the complimentary pocket shaped cover sections and having a transverse dimension substantially coextensive with the open edges of the cover sections, and means resiliently connecting the spine to at least one of the cover sections to provide an adjustable book cover for paperback books or magazines of various thicknesses and sizes.

Another object of the present invention is to provide a book cover of the type set forth wherein the spine is resiliently connected to one of the cover sections and fixedly connected to the other.

Still another object of the present invention is to provide a book cover of the type set forth wherein the spine is slidable with respect to at least one of the pockets.

A further object of the present invention is to provide a spine which has side runners at the top and bottom edges thereof to facilitate insertion of a book cover therealong.

The final object of the present invention is to provide a book cover of the type set forth wherein the resilient connecting means between the book cover sections is a rubberband.

These and other objects of the present invention may more readily be understood by reference to the following specification taken in conjunction with the accompanying drawings, in which:

DESCRIPTION OF THE PREFERRED EMBODIMENTS

Figure 2:
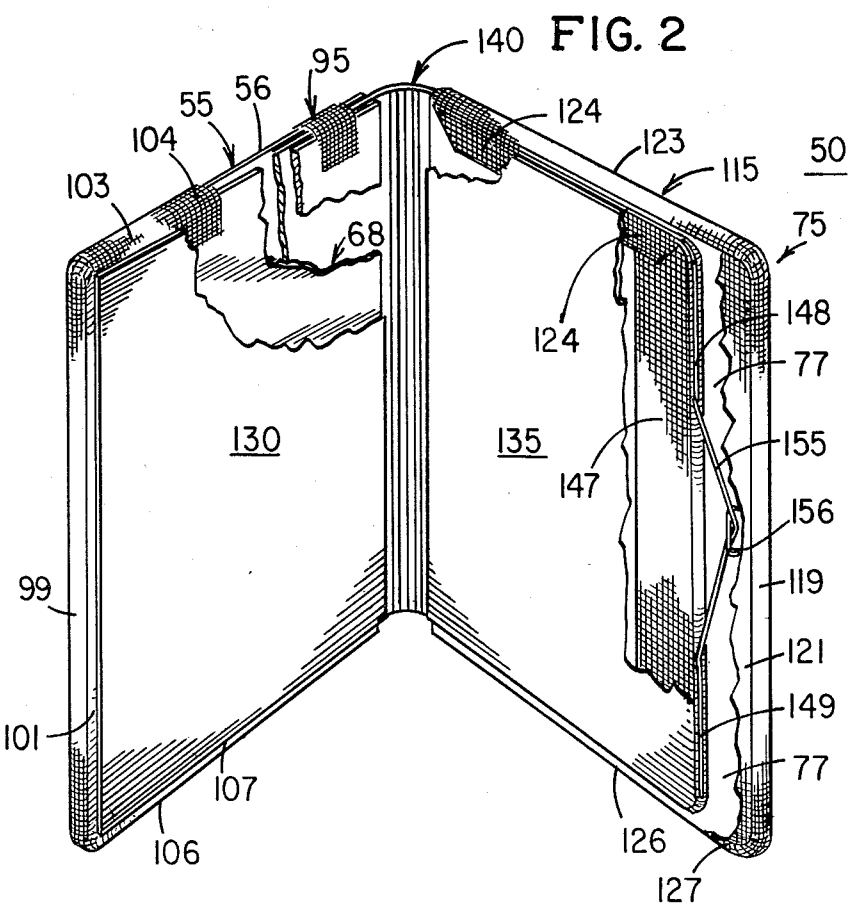
FIG. 2 is a completed view like FIG. 1 with the spine contracted.
Figure 1:
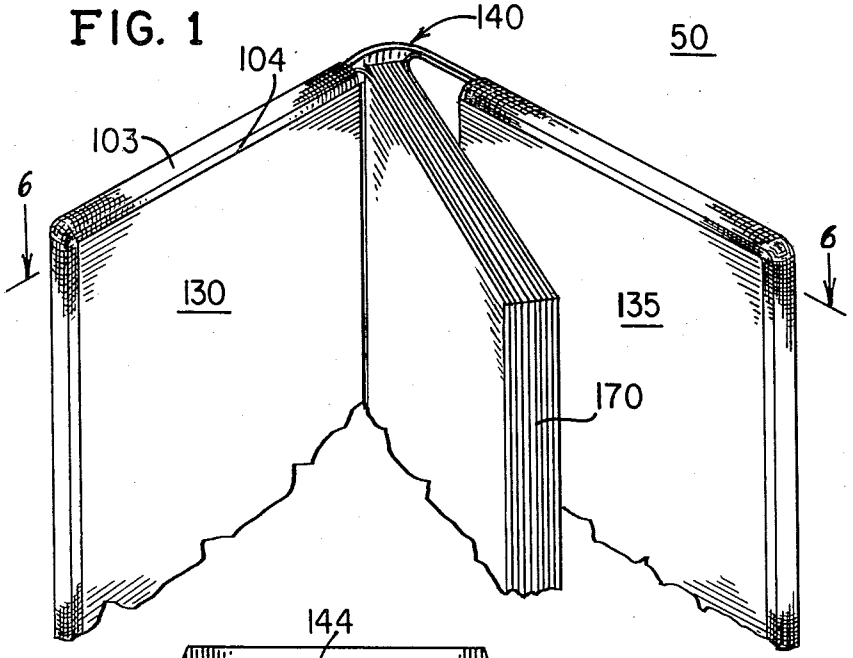
FIG. 1 is a perspective view of a portion of the book cover of the present invention with the spine expanded to facilitate the insertion of a book into the book cover sections.

Referring to the drawings there is disclosed a cover 50 of the present invention which includes two separate cover sections 55 and 75 interconnected by a spine 140. The cover section 55 is constructed from two spaced apart rigid members 56 and 66. The preferred construction material is 1/16 inch thick rigid paper board. Reference will be to paper board hereinafter but the invention is not restricted to the use thereof. The paper board member 56 has an inner surface 57 and an opposed outer surface 58. The board has an inner end 59 and an opposed outer end 61. In spaced relation to the paper board 56 is the paper board 66, also having inner and outer surfaces 67 and 68, respectively and inner and outer ends 69 and 71, respectively. These paper boards 56 and 66 are maintained in the spaced relationship in a manner hereinafter to be set forth.

The other cover section 75 is also comprised of two paper board members, the first paper board member 76 having inner and outer surfaces, respectively, 77 and 78 and inner and outer ends, respectively 79 and 81. Similarly, the other paper board member 86 has inner and outer surfaces, respectively 87 and 88 and inner and outer ends, respectively 89 and 91.

The cover sections 55 and 75 are shaped to accommodate covers of a book, magazine, pamphlet or the like in between the two paper board members which form the cover section. To this end, a flexible cover material 95 is wrapped around the paper boards 56 and 66 and maintain the paper boards in a spaced apart relation. Specifically, the flexible cover material 95 has an inner border 96 which is adhesively secured to the inside surface 57 of the board 56 a small distance inwardly from the inner end 59 of the paper board 56. The border flight 96 wraps around the end 59 as illustrated by the reference numeral 97 and then is adhesively secured along the outer flight 98 to the outer surface 58 of the paper board 56. Thereafter, the one piece flexible cover material 95 is secured to the outer end 61 of the paper board 56 and travels to the outer end 71 of the paper board 66. The spaced apart relationship between the paper boards 56 and 66 is maintained during the wrapping of the flexible cover material 95 therearound by means of a spacer board 160, also 1/16 inch thick which is placed intermediate the boards 56 and 66 during the wrapping of the flexible material. The flexible material 95 is wrapped around the ends 61 and 71, respectively, of the two paper boards 56 and 66 and thereafter adhesively secured along an outer border 101 which is approximately the same dimension as the border 96.

Also provided by the flexible cover material 95 is a top flight 103 which extends across the top edge of the paper board 56 and the top edge of the paper board 66 and terminates in a border 104 adhesively secured to the outer surface 68 of the paper board 66. Similarly, a bottom flight 106 extends around the bottom edges of the paper boards 56 and 66 and terminates in a border 107 adhesively secured to the outer surface 68 of the paper board 66. In this manner, the two rigid members 56 and 66 are connected one to the other and also arranged in a predetermined space relationship.

Similarly, the paper boards 76 and 86 are also provided with a flexible cover material 115. The flexible cover material 115 like the flexible cover material 95 and serves to maintain the paper boards 76 and 86 in spaced apart relation. To that end, a spacer board 160 is utilized to maintain the proper spacing during the placement of the flexible cover material 115 therearound. As with the previously described flexible material 95, the material 115 has an inner border 116 adhesively secured to the inner surface 77 of the board 76. The border 116 wraps around the end 79 of the paper board 76 as illustrated by the reference numeral 117 and then is adhesively secured along a flight 118 to the outer surface 78 of the paper board 76. Thereafter, a flight 119 of the flexible material 115 is adhesively secured to the outer ends 81 and 91 respectively of the paper boards 76 and 86, the spacing being maintained or provided by the spacer board 160. Thereafter, the flexible material 115 is adhesively secured to the outer surface 88 of the paper board 86 along the border flight 121. In this manner, the paper boards 76 and 86 are fixably connected one to the other with the spacing therebetween maintained, as were the boards 56 and 66. Assisting in the spacing, is the top flight 123 which extends over the top ends of the boards 76 and 86, respectively, and is adhesively secured to the outer surface 88 of the paper board 86 as at the border 124. Similarly, the bottom edges of the paper boards 76 and 86 are connected by a flight 126 which extends across both bottom edges and also terminates in a border 127 adhesively secured to the surface 88 of the board 86.

Decorative liners 130 and 135 are adhesively secured to the paper boards 66 and 86 respectively. The docorative liners 130 and 135 may be of any chosen color or design.

Figure 8:
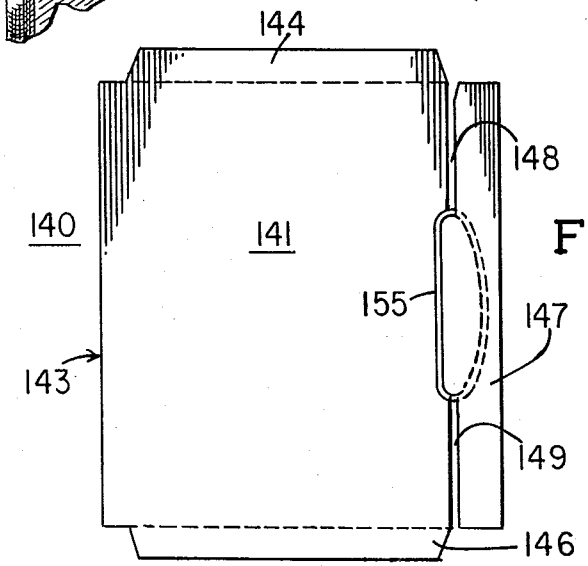
FIG. 8 is a front elevational view of the book cover spine showing the placement of the resilient mounting means prior to the folding of the spine flaps.

In the preferred embodiment, the spine 140 is a separate piece of flexible material and may be the same as the cover materials 95 and 115. The spine 140 consists of a piece of material having opposed surfaces 141 and an inner edge 143. A top flap 144 and a bottom flap 146 extends longitudinally and are indicated by the dashed lines in FIG. 8. Transversely extending slits 148 and 149 extend inwardly from the flaps 144 and 146 and terminate at points toward the center of the spine 140. A flexible connecting means such as a rubber band 155 fits in the terminal ends of the two slits 148 and 149.

Figure 6:
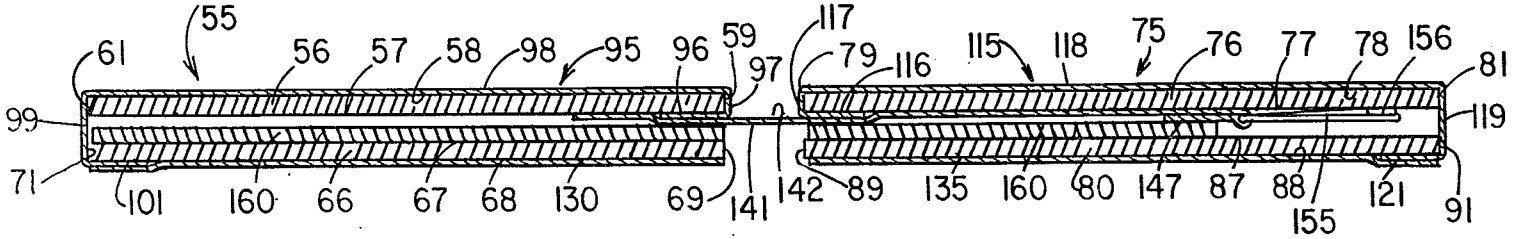
FIG. 6 is a top plan view partly broken away showing the joining of the book sections with the spine with a board mounted in the book section to provide the correct spacing.
Figure 7:
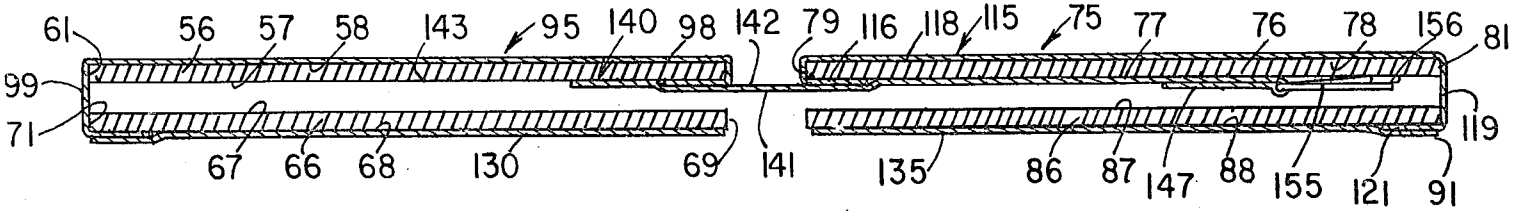
FIG. 7 is a view like FIG. 6 without the spacer board therein.

After the rubber band 155 is mounted in the slots or slits 148 and 149 aforesaid, the flap 147 formed by the two slots or slits 148 and 149 is folded over onto the surface 141 and adhesively secured thereto. Thereafter, the inner edge 143 and a border spaced inwardly thereof is secured to the surface 57 of the paper board 56 as illustrated in FIGS. 6 and 7. The free end of the rubber band 155 is fixably connected to the inside surface 77 of the paper board 76 by means of a staple 156. An important constructual feature of the present invention is that the flap 147 is folded over and adhesively secured to the surface 141 before the flaps 144 and 146 are secured, thereby insuring that the flaps 144 and 146 are outside the flap 147 and provide smooth running tracks or guides for a book cover inserted into the pocket formed by the opposed paper boards 76 and 86. These running tracks formed by the flaps 144 and 146 are critical to the substantially carefree performance of the present book cover 50, in that by this construction, which is illustrated in FIG. 2, the ends of the book covers inserted into the pockets 75 do not jam against the transversely extending edge of the flap 147.

Figure 5:
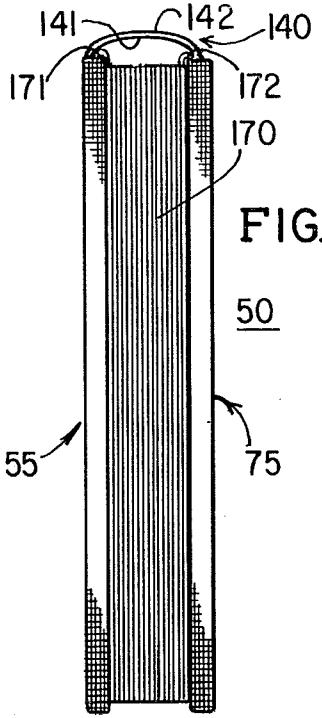
FIG. 5 is a view like FIG. 4 showing the expansion of the spine to accommodate a book of a given thickness.
Figure 4:
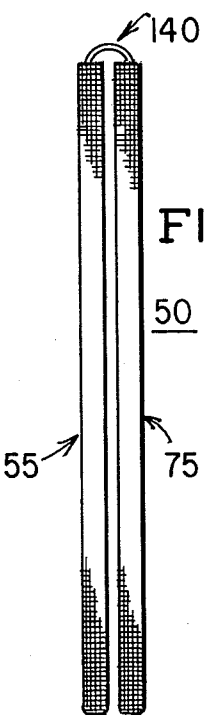
FIG. 4 is a top elevational view of a book cover of the subject invention without a book therein.
Figure 3:
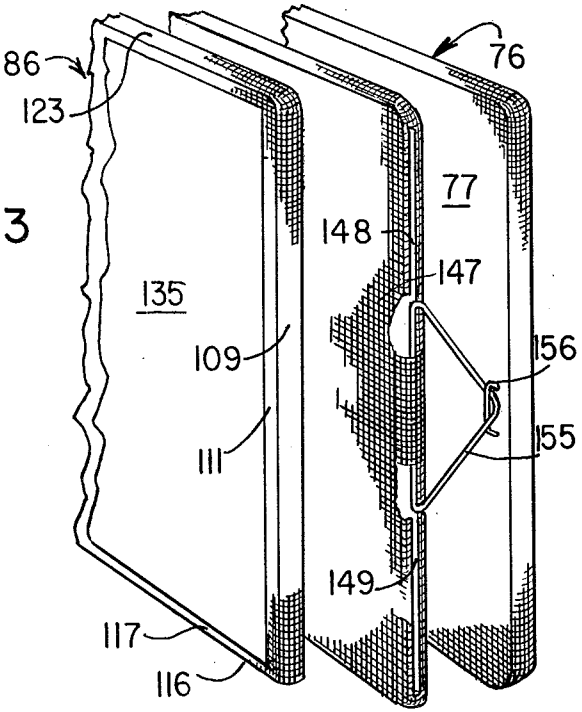
FIG. 3 is an expanded view of one of the book covers showing the spine resiliently mounted thereto.

Although there now has been described all the parts of the book cover 50 of the present invention, so that the book cover 50 is seen to accommodate automatically books 170 of various thicknesses, see FIGS. 4 and 5 wherein the book cover 50 is without a book therein in FIG. 4 and the spine 140 is automatically retracted and the book cover 50 of the present invention accommodates a relatively thick book in FIG. 5 with the spine 140 extended, certain steps in the making of the book cover 50 are important to the success thereof. In a constructional example, the book cover 50 is constructed to accommodate a standard size paperback book 4 1/4 inches by 7 inches. It is understood that this is a constructional example only and does not limit the invention to covers for paperback books, but it is illustrative of the preferred embodiment. The paper boards 56, 66, 76, and 86 are 1/16 inch thick and have dimensions of 4 5/6 inches by 7 1/16 inches. The paper boards 56 and 66 as well as the paper boards 76 and 86 are maintained 1/16 inch apart, as was explained. A cover material 95 is cut to the dimensions of $5\frac{3}{8}$ inch wide by 8 5/16 inch long. The paper board 56 is positioned on the 8 5/16 inch side and glued so that a border 96 of the cover material 95 having a width of about $\frac{1}{2}$ inch is obtained. At this point, the spine 140 is attached to the inside surface 57 of the paper board 56. About $\frac{1}{2}$ inch of the spine 140 is adhesively secured to the inside surface 57 of the paper board 56. The spine 140 is made from a material which is $5\frac{1}{2}$ inches wide and about 8 inches long. The border 147 is about 1 inch in width and the slits 148 and 149 are each about 2 inches in length. The thickness of the material which holds the rubber band 155 is about 3 inches in length. Again, flaps 144 and 146 are about ½ inch wide and fold over the flap 147 as previously described to provide the runners or guides which form a critical feature to the present invention.

After the edge 143 of the spine 140 and ½ inch border extending inwardly therefrom has been connected to the inside surface 57 of the paper board 56, the spaced board 160 is over laid on the paper board 56 and then the board 66 is positioned over the spacer board and the top and bottom flights 103 and 106, respectively, are secured along their respective borders 104 and 107 to the outer surface 68. Then the border 101 of the flexible material 95 is thereafter adhesively secured to the surface 68 of the paper board 66. Although the border 101 is similar to the border 96, the exact ½ inch dimension is not critical. Thereafter, the decorative liner 130 may be secured as illustrated.

The other cover section 75 is similarly produced with the flexible material 115 being secured along the border 116 and thence along the flight 118, respectively secured to the surfaces 77 and 78 of the paper board 76. Thereafter, the rubber band 155 is fixably connected by means of a staple 156 to the surface 77 of the paper board 76.

Thereafter, the paper board 86 as well as the spacer 60 are positioned and like the manufacture of the cover section 55, the top flight 123 and border 124 as well as the bottom flight 126 and the bottom border 127 are secured. Then the end flap 119 and the border 121 thereof are connected to complete the wrapping of the flexible material 115. Finally, the decorative material 135 is secured to the surface 88 of the paper board 86.

In this manner, the adjustable book cover 50 of the present invention is manufactured and constructed. The book cover 50 comprising the sections 55 and 75 interconnected by the spine 140 accommodates books, magazines and pamphlets of any thickness and of any size. Although, a cover construction was specifically illustrated for paperback books having cover dimensions of 4¼ inches by 7 inches it is clear that any size book or pamphlet can be accommodated by the cover 50. As seen, the spine 140 is fixably connected to the cover section 55 and resiliently connected to the cover section 75. The spine 140 is slidable with respect to the cover section 75 and thereby automatically accommodates books of various thicknesses.

While there has been presented what is considered to be the preferred embodiment of the present invention, it should be understood that various modifications and alterations may be made herein without departing from the true spirit and scope of of the present invention, and it is intended to cover within the claims appended hereto all such alterations, variations and modifications.

What is claimed is:

1. A protective and adjustable book cover for paperback books and magazines and the like, said cover comprising two complimentary sized cover sections, each of said cover sections having opposed and spaced apart rigid plies of substantially the same size connected along three edges thereof forming a pocket with the remaining edges open, means maintaining said rigid plies spaced apart a distance sufficient to receive therebetween a cover of an associated book or magazine, a spine connecting said complimentary pocket shaped cover sections and having a transverse dimension substantially coextensive with the open edges of said cover sections, and means resiliently connecting said spine to at least one of said cover sections to provide an adjustable rigid book cover for paperback books or magazines of various thicknesses and size.

2. The cover of claim 1, wherein a flexible material covers the outer surface of each outside ply and at least a portion of the inner surface of the respective pocket forming inside ply and connects the two overlying plies together and maintains the spaced apart relation therebetween.

3. The cover of claim 1, wherein said spine is a flexible material fixedly connected to one of said cover sections and resiliently connected to the other.

4. The cover of claim 1, wherein said spine is slidable with respect to one of said pockets to accomodate books and magazines of various thicknesses.

5. The cover of claim 1, wherein said connecting means is a rubber band.

6. The cover of claim 1, wherein said spine is a flat sheet of flexible material having an end flap of folded over material holding said connecting means to said spine.

7. The cover of claim 6, wherein said flat sheet has side runners of folded over material overlying the end flap providing smooth sliding surfaces for books inserted into the same pocket as said spine.

8. The cover of claim 1, wherein said plies are 1/16 inch thick paper boards spaced about 1/16 inch apart.

9. The cover of claim 8, wherein said connecting means is a number 16 rubber band.

* * * * *